US011611186B2

(12) United States Patent
Ruch et al.

(10) Patent No.: US 11,611,186 B2
(45) Date of Patent: Mar. 21, 2023

(54) PRESSING TOOL WITH SENSOR SYSTEM FOR AUTOMATED RECOGNITION OF A PRESSING JAW ASSEMBLY

(71) Applicant: Von ARX AG, Sissach (CH)

(72) Inventors: Matthias Ruch, Efringen-Kirchen (DE); Rudolf Kreuzer, Buchs (CH)

(73) Assignee: Von ARX AG, Sissach (CH)

( * ) Notice: Subject to any disclaimer, the term of this patent is extended or adjusted under 35 U.S.C. 154(b) by 700 days.

(21) Appl. No.: 16/574,289

(22) Filed: Sep. 18, 2019

(65) Prior Publication Data

US 2020/0127429 A1 Apr. 23, 2020

(30) Foreign Application Priority Data

Oct. 19, 2018 (EP) ..... 18201502

(51) Int. Cl.
*H01R 43/042* (2006.01)
*B25B 27/14* (2006.01)
*H01R 43/048* (2006.01)

(52) U.S. Cl.
CPC ..... *H01R 43/0428* (2013.01); *B25B 27/146* (2013.01); *H01R 43/048* (2013.01)

(58) Field of Classification Search
CPC ..... B21D 39/048; B25B 27/10; B25B 27/146; H01R 43/0428; H01R 43/048
See application file for complete search history.

(56) References Cited

U.S. PATENT DOCUMENTS 6,035,775 A * 3/2000 Nghiem ..... B25B 27/10 72/19.8
2016/0016222 A1* 1/2016 Bungter ..... H01R 43/042 29/515
2018/0161969 A1* 6/2018 Rosani ..... B23D 29/002
2020/0127429 A1* 4/2020 Ruch ..... H01R 43/048

FOREIGN PATENT DOCUMENTS

DE 202011004653 6/2011
EP 2308648 4/2011
EP 2794191 10/2014
WO WO-03084719 A2 * 10/2003 ..... B25B 27/10

OTHER PUBLICATIONS

European Search Report dated May 9, 2019; Application No. EP 18201502.4; 8 pages.
Chinese Office Action dated Sep. 17, 2021; 8 pages.

* cited by examiner

*Primary Examiner* — Minh N Trinh
(74) *Attorney, Agent, or Firm* — Mark E. Bandy; Rankin Hill & Clark, LLP

(57) ABSTRACT

A pressing tool for plastically deforming a tubular workpiece, and particularly a fitting is described. The pressing tool comprises a pressing jaw receptacle for coupling a pressing jaw assembly to the pressing tool. The pressing tool further comprises a drive which is adapted to drive a coupled pressing jaw assembly in order to apply force to a workpiece, and a sensor system which is adapted to identify a pressing jaw assembly and to provide corresponding sensor data, wherein a control is adapted to control the drive based on the sensor data. Also described are related methods, pressing jaw assemblies, and workpieces.

16 Claims, 3 Drawing Sheets

PRESSING TOOL WITH SENSOR SYSTEM FOR AUTOMATED RECOGNITION OF A PRESSING JAW ASSEMBLY

FIELD

The present invention relates to a pressing tool for plastically deforming a tubular workpiece, and particularly a fitting. Further, the invention relates to a method of operating such a pressing tool, a pressing jaw assembly to couple to a pressing tool as well as a tubular workpiece, and particularly a fitting.

BACKGROUND

Several methods of joining tubular workpieces are known in prior art. For example, pipes may be soldered or welded together. Furthermore, putting the end of a smaller pipe into one end of a larger pipe and subsequently pressing the two pipes against each other is known.

In other cases, pressing is carried out using a (compression) fitting. For this purpose, pressing tools such as pipe pressing tools may be used in order to join a pipe to a compression fitting, for example. Such a fitting may be designed as a piping and plumbing fitting that may be used as an adapter in a pipe, for example. A fitting may be made from various materials such as copper, aluminum, plastics, composite material and/or (stainless) steel.

A (tube) pressing tool may comprise pressing jaws made from metals such as steel, aluminum or the like, for example, which may be interchangeable. Furthermore, the pressing tool may comprise exchangeable pressing pliers which feature the pressing jaws. Other pressing jaw assemblies comprising pressing jaws are known as well. By means of the pressing jaws and/or the pressing jaw assembly, a force may be applied to the fitting in order to plastically deform the latter in such a manner that the fitting abuts a pipe as closely, tightly and firmly as possible. When using such a pressing tool, the pressing jaws may be pressed together in order to press a fitting arranged between them around a pipe. The pressing tool may be hand-held and be driven by a drive. Typically, electrical and/or hydraulic drives are used.

Typically, the pressing jaws and/or pressing jaw assemblies are workpiece-specific. For example, for pressing metal fittings such as copper or (stainless) steel fittings, different pressing jaws/pressing jaw assemblies are used than when plastic fittings pressed. The pressing tool may be adapted for different workpieces, particularly fittings, by exchanging the pressing jaws/pressing jaw assemblies. When such conventional pressing tools are used, the maximum pressing force is usually always applied during pressing, independently of the pressing jaws actually used and/or pressing jaw assembly and/or fittings actually used. However, this may be disadvantageous because the pressing force required for pressing plastic fittings, for example, is much smaller than that required for pressing metal fittings. This means that applying the maximum pressing force results in an unnecessary waste of energy.

Additionally, each type of pressing jaws used and/or pressing jaw assemblies used features characteristic pressing characteristics. For example, the pressing characteristics may depend on the mechanical advantage of the pressing jaw assembly, the material of the pressing jaws and the workpiece to be pressed. For example, a workpiece such as a fitting made from steel, should be pressed differently than a fitting made from plastics, also in order to guarantee a positive joint and a long durability of the pressed fitting as optimal as possible, for example.

Thus, the problem that underlies the present invention is to press a fitting against a pipe in a manner that is as optimal and material-friendly as possible. Particularly, an improved (pipe) pressing tool is to be provided which makes such pressing possible. These and other problems which will become apparent for the person skilled in the art from the following description are solved by a pressing tool as described herein, a method of operating a pressing tool as described herein, a pressing jaw assembly as described herein, and a tubular workpiece as described herein.

SUMMARY

The difficulties and drawbacks associated with previous approaches are addressed in the present subject matter as follows.

In one aspect, the present invention provides a pressing tool for plastically deforming a tubular workpiece. The pressing tool comprises a pressing jaw receptacle for coupling a pressing jaw assembly and pressing tool together. The pressing tool also comprises a drive adapted to drive a coupled pressing jaw assembly in order to apply a force to a workpiece. The pressing tool additionally comprises a sensor system adapted to identify a pressing jaw assembly and to provide corresponding sensor data. And, the pressing tool comprises a control adapted to control the drive based on the sensor data.

In another aspect, the present invention provides a method of operating a pressing tool for plastically deforming a tubular workpiece. The method comprises providing a pressing tool including a pressing jaw receptacle for coupling a pressing jaw assembly and the pressing tool together, a drive adapted to drive a coupled pressing jaw assembly in order to apply a force to a workpiece, a sensor system adapted to identify a pressing jaw assembly and to provide corresponding sensor data, and a control adapted to control the drive based on the sensor data. The method also comprises coupling the pressing jaw assembly to the pressing jaw receptacle of the pressing tool. The method also comprises identifying the pressing jaw assembly by means of the sensor system. The method additionally comprises gripping a workpiece by means of the coupled pressing jaw assembly. And, the method comprises controlling the pressing tool in accordance with the identified pressing jaw assembly in order to apply a force to a surface of the gripped workpiece by means of the pressing jaw assembly in order to plastically deform the workpiece.

In yet another aspect, the present invention provides a pressing jaw assembly to couple to a pressing tool comprising a label adapted to be identified by a sensor system of a pressing tool. The label comprises an RFID transponder or an NFC transponder.

In still another aspect, the present invention provides a tubular workpiece adapted to be plastically deformed by a pressing tool. The workpiece comprises means adapted to provide an identifier for the identification of the workpiece.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

Figure 1:
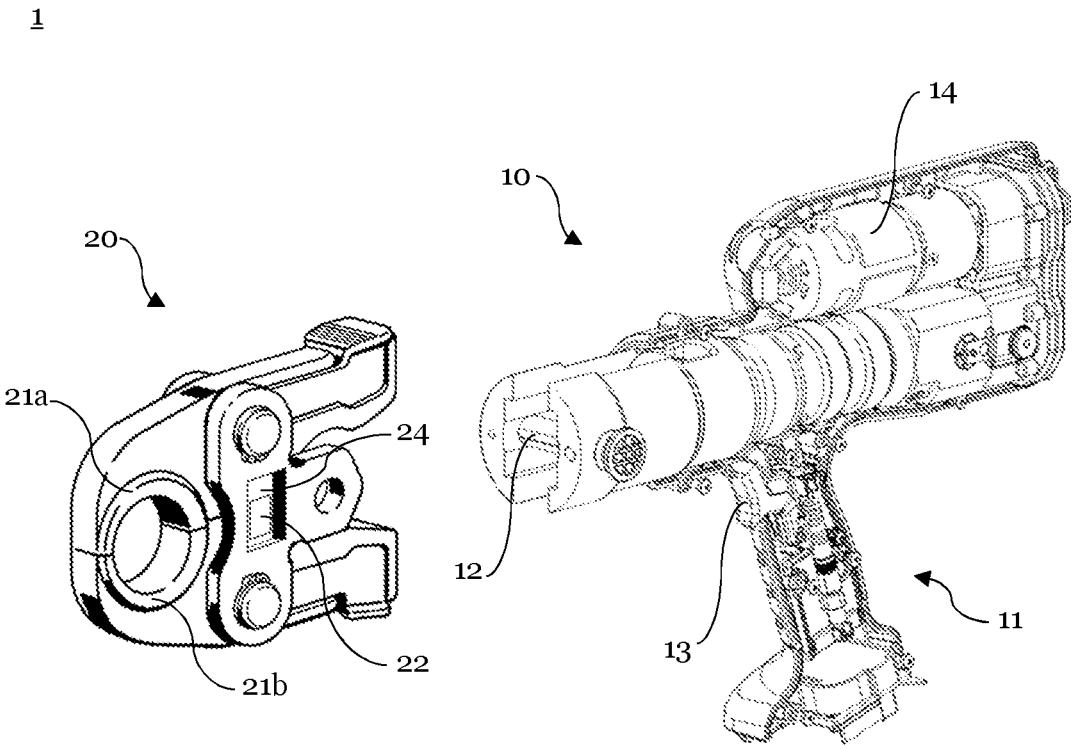
FIG. 1 shows an exploded view of a pressing tool system comprising a pressing tool and a pressing jaw assembly according to an embodiment of the present invention.

The present invention relates to a pressing tool for plastically deforming a tubular workpiece. The tubular workpiece may be a fitting, and be pressed against two pipes in order to join the latter, for example. The fitting may be made, for example, from copper, aluminum, plastics, composite material and/or (stainless) steel, at least partially. The pressing tool, in turn, may be adapted to plastically deform such a tubular workpiece such as a fitting, for example, in such a manner that it is joined with a part of a pipe arranged in the fitting. In particular, by means of the pressing tool, pressing may be performed in order to inseparably join together a fitting and a pipe by a positive and/or force-closed joint. For example, the fitting may be specified according to the standard DIN EN 1254-7.

Furthermore, the pressing tool comprises a pressing jaw receptacle for coupling a pressing jaw assembly and the pressing tool together. The pressing jaw receptacle couples to the pressing jaw assembly in such a manner that the pressing tool may drive pressing jaws of the pressing jaw assembly. For example, the coupling takes place by at least one coupling bolt. The pressing jaws of the pressing jaw assembly may be adapted to be movable relative to each other and may be closed and spread apart, for example, so that a tubular workpiece such as a fitting may be arranged between the pressing jaws in the spread state, for example. The pressing jaws of the pressing jaw assembly may be interchangeable. Different pressing jaw assemblies and/or pressing jaws may be designed for different tasks such as pressing, crimping or cutting. Typically, a pressing jaw assembly comprises at least two pressing jaws.

The pressing tool further comprises a drive that is adapted to drive the pressing jaw assembly in order to apply a force to the workpiece. The drive may comprise an electric motor, a pneumatic and/or a hydraulic drive unit as well as a transmission. By means of the drive, the pressing jaws of the pressing jaw assembly may be moved relative to each other in order to be driven into the closed state, for example. Here, the drive may provide at least some of the force that is necessary to deform the tubular workpiece, for example for joining a fitting to a part of a tube.

For this purpose, the drive may be directly coupled to the pressing jaw assembly or coupled to the pressing jaw assembly via a transmission in order to transmit the motive power to the pressing jaw assembly and the pressing jaws. The force acting upon the pressing jaws and/or the pressing jaw assembly may be variably set here by correspondingly varying the motor parameters or other parameters (such as transmission settings), for example.

Further, the pressing tool comprises a sensor system that is adapted to identify a pressing jaw assembly and to provide corresponding sensor data. The sensor system may be adapted to recognize an individual pressing jaw assembly or to recognize the kind of a pressing jaw assembly. For this purpose, the sensor system may comprise sensing means (e.g. a sensor) as an interface with the pressing jaw assembly and corresponding means for analysis which may comprise a processor and/or memory with corresponding program code. In this context, the sensing means may be provided at the pressing tool separately of the means for analysis. Here, the sensor system may be supplied via an energy source arranged at the pressing tool which may also supply energy to the drive and/or electric motor, for example. Further, the sensor system may be activated by a user/operator by means of a push button in order to perform the identification. In this way, the manner in which and the time at which the identification is to take place may be purposefully controlled. Furthermore, the sensor system may be adapted to recognize an exchange and, in particular, the coupling of a pressing jaw assembly to the pressing jaw receptacle and carry out the identification after having recognized the exchange and/or coupling.

Hence, the identification does not necessarily mean that a single pressing jaw assembly is identified as an individual pressing jaw assembly. Rather, it suffices for a pressing jaw assembly to be identified or recognized as being different from another pressing jaw assembly. For example, the pressing jaw assembly may be classified based on its model number in the course of the identification. So, in one example, it may be recognized that a pressing jaw assembly for pressing stainless steel fittings with a diameter of 15 mm is present and/or coupled. Here, resulting sensor data may characterize the identified pressing jaw assembly.

Furthermore, the pressing tool comprises a control that is adapted to control the drive based on the sensor data.

Thus, depending on the identified pressing jaw assembly, the drive is correspondingly controlled. Depending on which pressing jaw assembly and/or which type of pressing jaw assembly was recognized, the pressing jaw assembly may be driven in various manners by the drive, for example, in order to optimally deform the workpiece ultimately.

Thus, the present invention allows carrying out the deformation depending on the coupled pressing jaw assembly. In this way, according to the type of pressing jaw assembly used, an individual pressing force may be applied by means of the drive in order to achieve an optimal and material-friendly deformation of the workpiece. In this context, the use of the sensor system makes an automatic identification of the pressing jaw assembly and forwarding the corresponding data to the drive possible, which means that the user or operator of the pressing tool themselves do not have to provide any input and, accordingly, is not additionally burdened. In this way, the risk of operating errors may be reduced.

Preferably, the pressing tool comprises memory means with a database. Here, the database preferably comprises specific control parameters for controlling the pressing tool for a plurality of pressing jaw assemblies. Furthermore, the control may then control the drive according to the at least specific control parameter. Accordingly, depending on the identification of the pressing jaw assembly, corresponding control parameters may be loaded from the memory and/or from the database and be used in order to operate the drive. For example, control parameters for a pressing jaw assembly for stainless steel fittings and different control parameters for a pressing jaw assembly for copper fittings may be stored in the database. Depending on whether a pressing jaw assembly for stainless steel or copper fittings was identified by means of the sensor system, the corresponding control parameters may be loaded from the database and be used by the control in order to control the pressing tool and, ultimately, the drive. For different characteristics of the pressing jaw assembly (e.g. mechanical advantage, kind of pressing jaws, size of the workpiece to be pressed, material of the workpiece to be pressed and/or shape of the workpiece to be pressed), corresponding control parameters may be stored in the database in order to facilitate optimal pressing or deforming of the respective workpiece. In a preferred embodiment, accessing the database via a (wired or wireless) interface, for example for updating the content of the database, is possible.

Particularly preferably, the control parameters comprise pressing parameters which preferably comprise a maximum pressing force, a pressing speed, a pressing path and/or a pressing duration. Combinations of these parameters may be used. Thus, depending on the kind of pressing jaw assembly and/or the kind of workpiece to be pressed by means of the pressing jaw assembly, e.g. certain pressing forces, pressing speeds, pressing paths and/or pressing durations that are to be used for pressing or deforming the fitting together with the part of the pipe, for example, may be preset. For example, said parameters may be preset in the form of a pressing curve which defines a time curve of the pressing force, pressing path and/or pressing speed. Here, the person skilled in the art appreciates that corresponding control parameters need to be stored in the database, according to the intended purpose of the pressing tool. Furthermore, the control parameters may particularly comprise drive parameters which particularly comprise an output speed, a power output and/or an oil pressure, in particular. Combinations of these parameters may be used. Thus, depending on the kind of pressing jaw assembly and/or the kind of workpiece to be pressed by means of the pressing jaw assembly, various drive parameters may be stored in the database, which parameters may be loaded based on the identified pressing jaw assembly in order to ultimately deform the workpiece. The person skilled in the art appreciates that the pressing parameters or drive parameters may comprise motor and/or transmission parameters which may control the transmission of force from the drive to the pressing jaws.

Additionally, the sensor system may comprise at least one optical sensor, one contact-based sensor, one inductive sensor and/or capacitive sensor, wherein the sensor system may particularly be adapted to read an RFID and/or NFC transponder. Combinations of these sensors may be utilized. In particular, the sensor system may alternatively or additionally be adapted to read a bar code or a QR code. Furthermore, the sensor system may comprise a Bluetooth module which is adapted to read a corresponding Bluetooth module.

The use of an optical sensor or of a contact-based sensor facilitates the provision of a cost-efficient sensor system. A contact-based sensor may comprise an electrical contact which is brought into contact with a corresponding electrical contact of the pressing jaw/pressing jaw assembly in order to identify the pressing jaw/pressing jaw assembly.

The use of an inductive and/or capacitive sensor makes a reliable identification possible as inductive and/or capacitive sensors are less susceptible to pollutions than optical or contact-based sensors, for example. The RFID and/or NFC transponder and/or the corresponding Bluetooth module may have an identifier which is read during identification. Said identifier is characteristic of the kind of pressing jaw assembly or for an individual pressing jaw assembly and may, for example, comprise a serial number and/or type number. Based on the identifier that was read and on the database, the control parameters may be determined. Likewise, the RFID and/or NFC transponder and/or the corresponding Bluetooth module themselves may comprise the control parameters. The latter may then be read during identification and forwarded to the control. In this way, the database of the pressing tool does not necessarily have to be updated when new or additional pressing jaw assemblies are to be used. The pressing jaw assembly carries the required control parameters in the RFID and/or NFC transponder associated with it and/or in a corresponding Bluetooth module.

RFID (radio frequency identification) makes the identification of the pressing jaw assembly by means of electromagnetic waves possible. Here, the pressing jaw assembly can be automatically identified without contact by means of RFID technology. An RFID reader (sensor) arranged at the pressing tool may read the identifier and/or control parameters which may be provided by a corresponding RFID transponder of the pressing jaw assembly. An RFID transponder may be read without any additional power supply. This means that the pressing jaw assembly may be a passive device and does not require any additional interface or source for the supply of electric power.

NFC technology, or near field communication, is an international communication standard based on RFID technology for the contact-less exchange of data by means of electromagnetic induction or capacitive transmission. The communication between the corresponding NFC devices may be active-passive or active-active. Presently, the active part, i.e. the part that is supplied with electric power, preferably is provided in the pressing tool and the passive part is preferably provided in the pressing jaw assembly. This means that the pressing jaw assembly may be a passive device and does not require any additional interface or source for the supply of electric power.

Bluetooth communication facilitates short-range data transfer between devices by means of radio technology. Communication takes place by means of an industry standard that was developed accordingly, for example according to the standard IEEE 802.15.1.

In particular, a first reading range of the sensor system may be restricted and be 0.3 m maximum, preferably 0.2 m maximum, and most preferably 0.1 m maximum. Furthermore, the first reading range of the sensor system may be selected in such a manner that only one coupled pressing jaw assembly may be identified. The restriction of the first reading range prevents any unintentional identification of a wrong pressing jaw assembly that is in the proximity of the pressing tool. For example, the pressing tool is provided together with a plurality of pressing jaw assemblies in a transport case or on a workbench. Upon initial operation of the pressing tool, only the pressing jaw assembly that is coupled and/or to be coupled should be identified. This can be ensured by restricting the first reading range.

Furthermore, the sensor system may be adapted to identify a workpiece, wherein the storage medium comprises a database which comprises at least one specific control parameter for a plurality of workpieces, wherein the control is adapted to control the drive in accordance with the at least one specific control parameter.

Hence, depending on the identified workpiece, the drive is correspondingly controlled. Depending on which kind/type of workpiece was recognized, the pressing jaws may be differently driven by the drive, for example, in order to optimally deform the workpiece ultimately. Here, both the kind of workpiece and the kind of pressing jaw assembly may be taken into consideration for selecting the control parameters. In particular, checking whether the identified pressing jaw assembly matches the workpiece to be pressed is possible. Should this not be the case, an alert may be issued in order to prevent erroneous pressing and/or damaging the pressing tool. Likewise, the control parameters may be adapted to match the identified workpiece and too strong pressing or application of excessive force may be prevented in this manner. For example, if a pressing jaw assembly for pressing stainless steel fittings is coupled to the pressing tool and the workpiece to be pressed is a copper fitting, solely taking the kind of pressing jaw assembly into account would result in a pressing force that is too strong being applied. If, however, the kind of workpiece is also recognized, the pressing force may be reduced accordingly, and the workpiece may be pressed with the potentially unsuitable pressing jaw assembly—but at a reduced pressing force.

Hence, the present invention allows carrying out the deformation depending on the object to be deformed and the pressing jaw assembly used. In this manner, depending on the kind of workpiece used and/or the coupled pressing jaw assembly, an individual pressing force may be applied by means of the drive in order to achieve an optimal and material-friendly deformation without damaging the workpiece or the pressing tool.

A second reading range for identifying the workpiece may preferably be in the range of 0 meters to 5 meters, more preferably in the range of 0.01 meters to 2 meters, more preferably in the range of 0.02 meters to 1 meters and more preferably in the range of 0.05 meters to 0.5 meters. Thus, the sensor system is only able to identify workpieces within the second range. This makes it possible that only workpieces that actually are to be deformed are identified. An unintentional identification of distant workpieces not to be deformed is at least partially prevented. Depending on the sensors used, the first and the second reading range may be different from each other.

Preferably, the sensor system is adapted for feature recognition of characteristic features of the workpiece, particularly of characteristic geometrical features of the pressing jaw assembly and/or a workpiece. For example, a shape and/or a size of at least a part of the pressing jaw assembly and/or of the workpiece may be recognized by means of the sensor system. Based on said characteristic features, at least the kind of pressing jaw assembly and/or workpiece may be identified, and subsequently the drive may be accordingly controlled in order to optimally deform the workpiece.

In one preferred embodiment, the sensor system comprises a sensor such as a camera, an optical scanner, an RFID reader, an NFC reader and/or a Bluetooth module for identifying the workpiece. Combinations of these may be used. The same sensor or different sensors and/or types of sensors may be used to identify the workpiece and the pressing jaw assembly. The camera may be an optical camera which may have a resolution and quality that are sufficient for identifying at least the kind of workpiece. For example, a fitting with a diameter of 15 mm may be identified by means of the camera. Furthermore, based on color values, conclusions may be drawn as to the material of the workpiece. By means of the optical scanner, the RFID reader, the NFC reader and/or the Bluetooth module, data or identifiers may be recognized which, for example, may be provided by the workpiece itself and/or the pressing jaw assembly and allow for the workpiece to be identified. For example, the optical scanner may recognize a bar code or a QR code that is arranged on the workpiece. In order to guarantee identification by means of the optical camera or optical scanner, a lighting means may also be provided at the pressing tool which may lighten or illuminate at least part of the region that may be sensed by the camera or by the scanner.

Preferably, the sensor system is adapted to recognize a bar code on the workpiece, a QR code on the workpiece, an identifier in an RFID transponder at the workpiece, an identifier in an NFC transponder at the workpiece and/or an identifier in a Bluetooth module at the workpiece. The person skilled in the art appreciates that the workpiece may be equipped with corresponding codes or transponders or modules in order to provide the pressing tool with corresponding data for identifying—at least the kind of—the workpiece.

Furthermore, the sensor of the sensor system may be arranged directly at the pressing jaw receptacle. In one preferred embodiment, the sensor is at least partially covered by an element of the pressing tool in a first configuration of the pressing tool and is exposed by the element in a second configuration of the pressing tool. For example, a sensor of the sensor system may be covered by a part of the housing of the pressing tool, which may protect the sensor from pollution or other surrounding influencing factors. When the pressing jaws are spread apart and/or opened, which may correspond to the second configuration, the sensor or at least a portion of the sensor is uncovered and/or exposed. Now, the pressing jaw assembly and/or the workpiece may be identified by means of the sensor system. During the subsequent deformation of the workpiece, the pressing jaws are moved towards each other and/or put into the first configuration, which may, in turn, cover at least part of the sensor by a part of the housing. This also ensures that the identification by means of the sensor system only takes place if a deformation of the workpiece is to take place. In this way, any unintentional wrong identification of a workpiece that is in proximity (e.g. lies on a workbench) is prevented.

Preferably, the pressing jaws of the pressing jaw assembly, and particularly preferably, the entire pressing jaw assembly, is free from the sensor system. Hence, according to this embodiment, no elements of the sensor system are arranged at the pressing jaws and/or pressing jaw assembly. This means that the sensor system may, for example, exclusively be arranged at or in a handle of the pressing tool. This makes easy interchangeability of the pressing jaws and/or pressing jaw assembly possible. In a different preferred embodiment, at least part of the sensor system is arranged at the pressing jaws and/or pressing jaw assembly, particularly in a recess of the pressing jaws in order to protect the sensor system, for example. Here, the sensor system may be coupled to the motor of the pressing tool via a coupling interface.

Preferably, at least part of the sensor system is arranged in a housing of the pressing tool. If the sensor system is adapted to read an RFID and/or NFC transponder or if it comprises a Bluetooth module, the entire sensor system may be arranged on or within the housing of the pressing tool. In this context, at least parts of the housing of the pressing tool are permeable for the read data. In particular, the housing material may comprise glass, ceramics, plastics or composite materials which are at least partially permeable for electromagnetic radiation. Likewise, the housing may have suitable slots in order to make reading possible. Thanks to this arrangement, the sensor system may be protected from pollution and other surrounding influencing factors as at least parts of it are shielded by the housing of the pressing tool.

Particularly preferably, the pressing jaw assembly may at least partially cover the sensor of the sensor system when the pressing jaw assembly is coupled to the pressing jaw receptacle, with the sensor being at least partially uncovered when no pressing jaw assembly is coupled to the pressing jaw receptacle. Hence, the sensor system and/or the sensor may be protected from pollution or other surrounding influencing factors. Additionally, the reading accuracy of the sensor system may be increased as the sensor system and/or the sensor of the sensor system is arranged directly adjacent to the coupled pressing jaw receptacle and is not covered by other parts such as any part of the housing. Hence, a very short maximum first reading range may be realized and the risk of a wrong identification of adjacent pressing jaw receptacles that are not coupled may be reduced.

Preferably, the pressing tool comprises a protocol storage adapted to store the sensor data and control data. In this manner, the coupling process and/or deformation process may be configured to be trackable. All or some data on the coupling process and/or the deformation process may be stored in the protocol storage in order to make quality control of individual deformations possible, for example. Access to the protocol storage is possible via a wireless or wired interface for reading the corresponding data.

The present invention further relates to a method of operating a pressing tool in accordance with the descriptions above for plastically deforming a tubular workpiece such as a fitting. The method comprises the following steps: providing a pressing tool as described herein; coupling a pressing jaw assembly to the pressing jaw receptacle of the pressing tool; identifying the pressing jaw assembly by means of the sensor system and preferably identifying the workpiece; gripping the workpiece by means of the coupled pressing jaw assembly; controlling the pressing tool in accordance with the identified pressing jaw assembly and preferably in accordance with the identified workpiece in order to apply a force to the surface of the gripped workpiece by means of the pressing jaw assembly in order to plastically deform the workpiece.

Identifying the pressing jaw assembly make take place after the coupling or before the coupling, and particularly during the coupling. For the purpose of generating the force, the drive of the pressing tool may be accordingly controlled. Depending on the identification step, for example a reduced or increased pressing force, pressing duration and/or pressing speed may be set, depending on the pressing jaw assembly and/or type of workpiece that was identified.

In accordance with the present invention, particularly the method steps of identifying, gripping and/or controlling may be implemented in a computer program, with the computer program being able to cause a corresponding pressing tool system to perform the respective steps.

The present invention further relates to a pressing jaw assembly to couple to a pressing tool for plastically deforming a tubular workpiece, and particularly a fitting. For example, said pressing jaw assembly may be coupled to a pressing tool in accordance with the descriptions above. The pressing jaw assembly comprises a label adapted to be identified by the sensor system of the pressing tool, with the label preferably comprising an RFID transponder or an NFC transponder. Preferably, the label is arranged in a recess of the pressing jaw assembly in order to protect it from pollution, damage and other surrounding influencing factors. In particular, the recess may be sealed. For example, the recess comprising the label may be sealed by a plastic material, such as an epoxy resin, glass or ceramics. The sealant may completely surround and/or cover the label.

The present invention further relates to a tubular workpiece, particularly a fitting, which is adapted for plastic deformation by a machine. The tubular workpiece may be deformed according to the descriptions above by a pressing tool, for example. In this context, the workpiece, particularly a fitting, may be designed in accordance with the descriptions above and, for example, be made from copper, plastics, composite material and/or (stainless) steel. Here, the tubular workpiece comprises a means which is adapted to provide an identifier for the identification of the workpiece. In this context, the means may be designed according to the descriptions above, for example as a bar code or QR code. In particular, the means may comprise a transponder, particularly RFID or NFC transponder, which is adapted to provide the identifier.

In FIG. 1, a pressing tool system 1 is shown which comprises a pressing tool 10 as well as a pressing jaw assembly 20 according to an embodiment of the present invention. In this context, the pressing tool 10 comprises a handle 11 which may be hand-held by an operator and/or user. Pressing jaw assembly 20 may be removably coupled to handle 11. Pressing jaw assembly 20 comprises two pressing jaws 21*a*, 21*b* by means of which a workpiece (fitting) may be gripped and plastically deformed. For this purpose, a drive 14 such as an electric motor with a transmission which may drive pressing jaw assembly 20 and, ultimately, move pressing jaws 21*a*, 21*b* via a coupling interface in order to deform the fitting, is provided in handle 11. In order to start the process of deforming the fitting, an operator may actuate a corresponding actuating lever 13. By accordingly actuating lever 13, pressing jaws 21*a*, 21*b* are first spread apart in order to grip a fitting and then pressed together in order to deform the fitting. Coupling pressing jaw assembly 20 to pressing tool 10 takes place via pressing jaw receptacle 12 which may comprise a bolt, for example.

Further, a sensor system 40 (see FIG. 4) is provided at pressing tool 10. In this embodiment, the sensor system comprises an inductive and/or capacitive sensor and, particularly, is adapted to read an RFID and/or NFC transponder 22. By actuating lever 13 for spreading pressing jaws 21*a*, 21*b* apart in order to grip a fitting, sensor system 40 is activated. Equally, sensor system 40 may be activated by coupling a pressing jaw assembly 20 to pressing jaw receptacle 12. Here, in the activated state, sensor system 40 may recognize and read an identifier of a corresponding pressing jaw assembly 20, for example. The identifier may be stored in a transponder 22. Equally, the transponder may include stored control data which may be read by sensor system 40. Based on said identifier, pressing jaw assembly 20 may be identified by means of sensor system 40. Additionally, sensor system 40 is able to identify the type of a workpiece. Further, when lever 13 is actuated accordingly, drive 14 is driven in order to apply a force to the fitting arranged between pressing jaws 21*a*, 21*b*. For this purpose, drive 14 is controlled depending on which pressing jaw assembly 20 and/or which kind of workpiece was identified.

Figure 2:
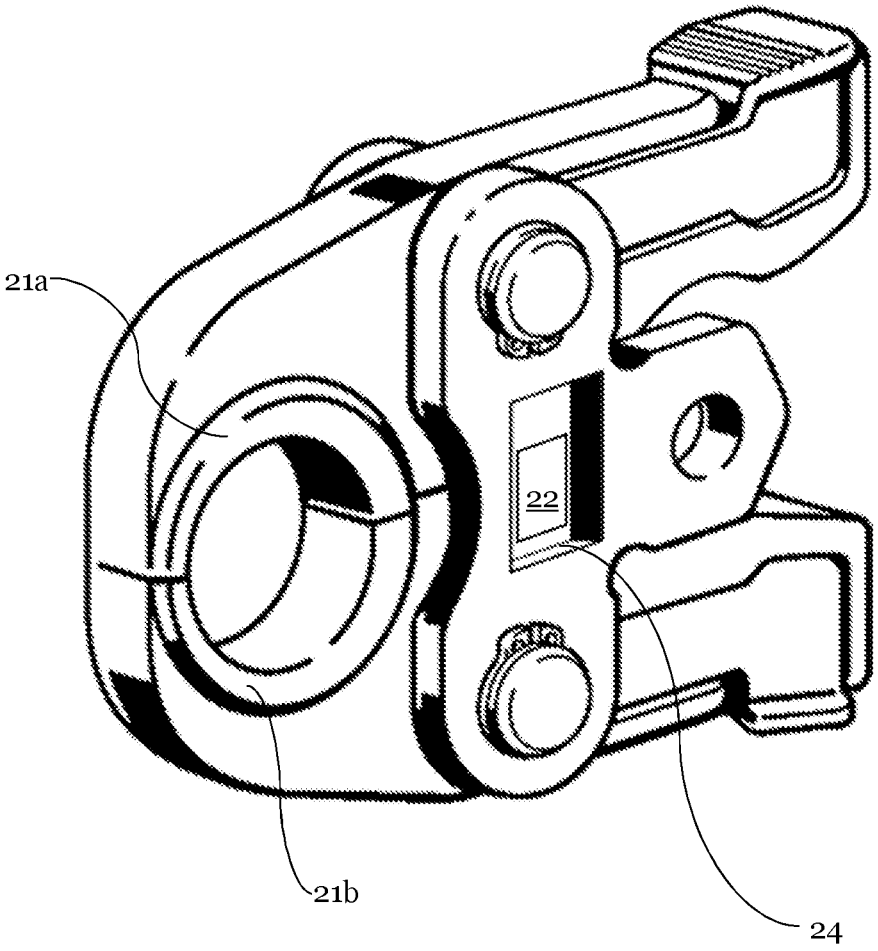
FIG. 2 shows a pressing jaw assembly with pressing jaws according to an embodiment of the present invention.

In FIG. 2, a pressing jaw assembly 20 with pressing jaws 21*a*, 21*b* according to an embodiment of the present invention is shown. The pressing jaw assembly may be removably coupled to a pressing jaw receptacle 12 of a pressing tool 10. In a recess 24, a transponder 22 (for example, an RFID or NFC transponder) is arranged. When pressing jaw assembly 20 is coupled to pressing jaw receptacle 12 of a pressing tool 10, sensor system 40, and particularly a sensor of the sensor system, is at least partially covered.

Figure 3:
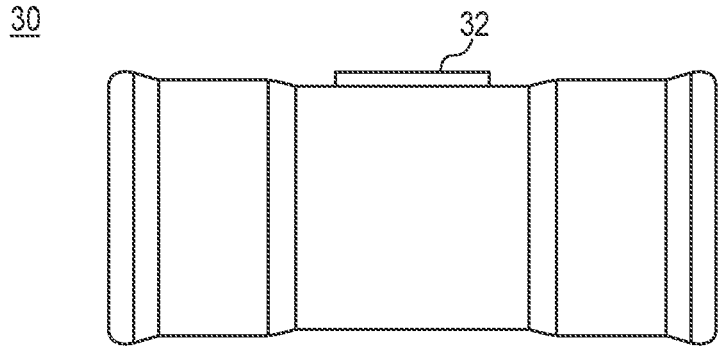
FIG. 3 shows a tubular workpiece according to an embodiment of the present invention.

In FIG. 3, a possible embodiment of a tubular workpiece according to an embodiment of the present invention is shown. The workpiece that is shown is designed in the form of a fitting 30 here. In this context, fitting 30 comprises a means 32 for providing an identifier for the identification of the respective fitting 30, for example at a pressing tool 10 according to FIG. 1. Fitting 30 shown in FIG. 3 comprises an RFID transponder 32 in which at least one identifier is stored. Here, the identifier characterizes at least the kind of fitting 30. By means of a corresponding RFID reader at the pressing tool, e.g. by means of the sensor described with respect to FIG. 1, the identifier stored in the RFID transponder 32 of fitting 30 may be read in order to identify fitting 30.

Figure 4:
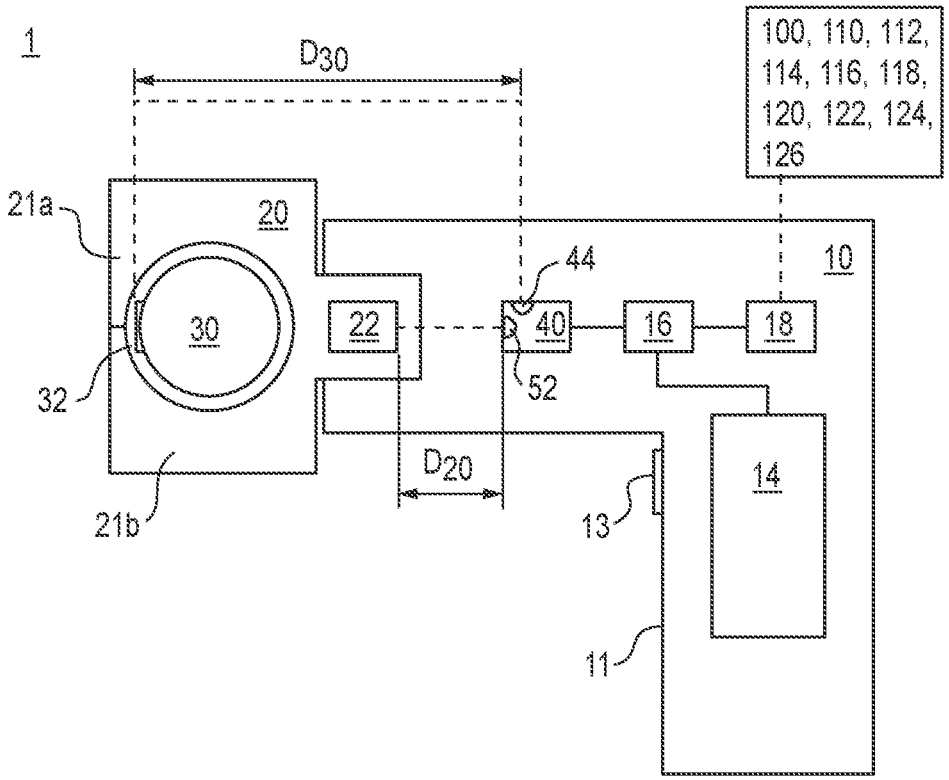
FIG. 4 shows a schematic illustration of a pressing tool system comprising a pressing tool, a pressing jaw assembly and a tubular workpiece according to an embodiment of the present invention.

FIG. 4 is a schematic illustration of pressing tool system 1. The system comprises a pressing tool 10 with a pressing jaw assembly 20 removably coupled to it. Pressing jaws 21*a*, 21*b* of pressing jaw assembly 20 grip a tubular workpiece 30. Pressing tool 10 further comprises a handle 11 for gripping pressing tool 10, and a lever 13 for actuating pressing tool 10. Additionally, pressing tool 10 comprises a sensor system 40 which comprises two sensors 42, 44 in the present illustration. Sensor 42 serves to identify pressing tool assembly 20 by means of transponder 22 and has a maximum first reading range D20. In this context, first reading range D20 of the sensor system is selected in such a manner that only a coupled pressing jaw assembly 20 may be identified. The restriction of first reading range D20 prevents any unintentional identification of a wrong pressing jaw assembly that is in the proximity of pressing tool 10. Sensor 44 serves to identify workpiece 30 by means of transponder 32. Sensor 44 has a second reading range D30. In this context, second reading range D30 is selected in such a manner that sensor system 40 may only identify workpieces 30 that are in the close proximity of pressing jaws 21*a*, 21*b* and/or are gripped by pressing jaws 21*a*, 21*b*. Furthermore, the sensor system may comprise a sensor which serves both the identification of pressing jaw assembly 20 and the identification of workpiece 30.

Furthermore, pressing tool 10 comprises a storage medium 18 with a database. In this context, the database preferably comprises specific control parameters 100 for a plurality of pressing jaw assemblies 20 and/or workpieces 30 for controlling pressing tool 10. A control 16 of pressing tool 10 may control drive 14 in accordance with the at least one specific control parameter 100. Examples of control parameter 100 include pressing parameters 110 such as a maximum pressing force 112, a pressing speed 114, a pressing path 116, a pressing duration 118, and combinations thereof. Additional examples of control parameter 100 include drive parameters 120 such as a predetermined output speed 122, a power output 124, a predetermined oil pressure 126, and combinations thereof.

The person skilled in the art appreciates that individual elements of the embodiments mentioned above may be combined or exchanged with each other.

LIST OF REFERENCE SIGNS

1 Pressing tool system
10 Pressing tool
11 Handle
12 Pressing jaw receptacle
13 Actuating means
14 Drive
16 Control
18 Storage medium
20 Pressing jaw assembly
21*a*, 21*b* Pressing jaws
22 Transponder
24 Recess
30 Workpiece (fitting)
32 Transponder
40 Sensor system
42, 44 Sensors
D20 First reading range
D30 Second reading range Many other benefits will no doubt become apparent from future application and development of this technology.

All patents, applications, standards, and articles noted herein are hereby incorporated by reference in their entirety.

The present subject matter includes all operable combinations of features and aspects described herein. Thus, for example if one feature is described in association with an embodiment and another feature is described in association with another embodiment, it will be understood that the present subject matter includes embodiments having a combination of these features.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A pressing tool for plastically deforming a tubular workpiece, the pressing tool comprising:

a pressing jaw receptacle for coupling a pressing jaw assembly and the pressing tool together;

a drive adapted to drive a coupled pressing jaw assembly in order to apply a force to a workpiece;

a sensor system adapted to identify the pressing jaw assembly and to provide sensor data, wherein a sensor of the sensor system is arranged directly at the pressing jaw receptacle and wherein the sensor is at least partially covered by an element of the pressing tool in a first configuration of the pressing tool and the element exposes the sensor in a second configuration of the pressing tool;

a control adapted to control the drive based on the sensor data.

2. The pressing tool according to claim 1, further comprising a storage medium with a database which comprises at least one control parameter for a plurality of pressing jaw assemblies, wherein the control is adapted to control the drive in accordance with the at least one specific control parameter.

3. The pressing tool according to claim 2, wherein the at least one control parameter comprises pressing parameters selected from the group consisting of a maximum pressing force, a pressing speed, a pressing path, a pressing duration, and combinations thereof.

4. The pressing tool according to claim 2, wherein the at least one control parameter comprises drive parameters selected from the group consisting of a predetermined output speed, a power output, a predetermined oil pressure, and combinations thereof.

5. The pressing tool according to claim 1, wherein the sensor system comprises at least one sensor selected from the group consisting of an optical sensor, a contact-based sensor, an inductive sensor, a capacitive sensor, and combinations thereof.

6. The pressing tool according to claim 1 wherein the sensor system is adapted to read an RFID and/or NFC transponder.

7. The pressing tool according to claim 1 wherein the sensor system is adapted to read a bar code and/or a QR code.

8. The pressing tool according to claim 1 wherein the sensor system is selected so that only a coupled pressing jaw assembly is identified.

9. The pressing tool according to claim 1, wherein the sensor system has a maximum first reading range (D20) of 0.3 m maximum.

10. The pressing tool according to claim 1, further comprising a storage medium, wherein the sensor system is adapted to identify a workpiece, wherein a second reading range (D30) for the identification of the workpiece is in a range of 0 m to 5 m, and wherein the storage medium comprises a database which comprises at least one specific control parameter for a plurality of workpieces, wherein the control is adapted to control the drive in accordance with the at least one specific control parameter.

11. The pressing tool according to claim 1, wherein the sensor system is adapted for feature recognition of characteristic features of the pressing jaw assembly and/or a workpiece.

12. The pressing tool according to claim 11 wherein the feature recognition of characteristic features are characteristic geometrical features.

13. The pressing tool according to claim 1, wherein the sensor system is adapted to recognize at least one selected from the group consisting of a bar code on a workpiece, a QR code on a workpiece, an identifier in an RFID transponder on a workpiece, an identifier in an NFC transponder on a workpiece, an identifier in a Bluetooth module on a workpiece, and combinations thereof.

14. The pressing tool according to claim 1, wherein the pressing jaw assembly includes pressing jaws and the pressing jaws are free from the sensor system.

15. The pressing tool according to claim 1, wherein the pressing jaw assembly at least partially covers a sensor of the sensor system when the pressing jaw assembly is coupled to the pressing jaw receptacle and wherein the sensor is at least partially uncovered when no pressing jaw assembly is coupled to the pressing jaw receptacle.

16. The pressing tool according to claim 1, further comprising a protocol storage adapted to store sensor data and control data.

* * * * *